US009574855B2

(12) United States Patent
Davis

(10) Patent No.: US 9,574,855 B2
(45) Date of Patent: Feb. 21, 2017

(54) AUTOMATICALLY RESETTING SHOOTING TARGET

(71) Applicant: Stephen J. Davis, Nelsonville, OH (US)

(72) Inventor: Stephen J. Davis, Nelsonville, OH (US)

( * ) Notice: Subject to any disclaimer, the term of this patent is extended or adjusted under 35 U.S.C. 154(b) by 0 days.

(21) Appl. No.: 14/705,066

(22) Filed: May 6, 2015

(65) Prior Publication Data

US 2016/0327378 A1 Nov. 10, 2016

(51) Int. Cl.
*F41J 7/00* (2006.01)
*F41J 7/04* (2006.01)

(52) U.S. Cl.
CPC .... *F41J 7/04* (2013.01); *F41J 7/00* (2013.01)

(58) Field of Classification Search
CPC ..... F41J 7/00–7/06; F41J 5/18; A63F 9/0204
USPC ..... 273/388, 390–392, 406, 407
See application file for complete search history.

(56) References Cited

U.S. PATENT DOCUMENTS 675,804 A * 6/1901 Tyrell ..... F41J 7/04 273/392
1,348,540 A 8/1920 Briggs
1,415,823 A * 5/1922 Fenton ..... F41J 7/04 273/388
1,640,954 A * 8/1927 Mach ..... F41J 9/02 273/369
1,845,609 A 2/1932 Knipper
2,561,733 A 7/1951 Foyst
2,957,694 A 10/1960 Barber et al.
2,967,712 A * 1/1961 Breitenfeldt ..... F41J 7/04 248/156
3,411,784 A 11/1968 Lawrence
3,814,429 A * 6/1974 Lienhard ..... A63B 63/06 273/127 D
3,915,454 A * 10/1975 Saunders ..... F41J 7/04 273/127 R
3,979,118 A * 9/1976 Saunders ..... F41J 7/04 273/127 R
4,093,227 A * 6/1978 Saunders ..... F41J 7/04 273/388

(Continued)

OTHER PUBLICATIONS

IPSC Precision Rifle Target—Mike Gibson Manufacturing; website—http://mgmtargets.com/tstore/index.php?main_page=product_info&cPath=15&products_id=52; four pages.

(Continued)

*Primary Examiner* — Mark Graham
(74) *Attorney, Agent, or Firm* — Jason H. Foster; Kremblas & Foster

(57) ABSTRACT

An automatically resetting target has a plate that rests in a removable base at a substantially vertical orientation. An apparatus mounted to the rear of the plate includes a pivotably mounted carriage with first and second legs extending radially away, at a relative angle, from a pivot point that is mounted between two openings. The first leg has a first striker plate that aligns with the first opening when the carriage is in a first position, and the second leg has a second striker plate that aligns with the second opening when the carriage is in a second position. By striking the first striker with a projectile, such as a bullet, a shooter moves the carriage and places the second striker behind the second hole. By striking the second striker with a projectile, the shooter moves the carriage and places the first striker behind the first hole.

15 Claims, 5 Drawing Sheets

(56) References Cited

U.S. PATENT DOCUMENTS

| | | | | | |
|---|---|---|---|---|---|
| 4,540,182 | A | | 9/1985 | Clement | |
| 4,949,980 | A | | 8/1990 | Hoy | |
| 5,257,790 | A | * | 11/1993 | Meadows | F41J 7/04 273/389 |
| 5,263,722 | A | | 11/1993 | Rosellen | |
| 5,324,043 | A | | 6/1994 | Estrella | |
| 5,346,226 | A | | 9/1994 | Block | |
| 5,788,245 | A | * | 8/1998 | Hada | A63F 9/0204 273/392 |
| 6,257,583 | B1 | | 7/2001 | Roberson | |
| 6,347,798 | B1 | | 2/2002 | Quiring et al. | |
| 6,502,820 | B2 | | 1/2003 | Slifko | |
| 6,896,267 | B1 | | 5/2005 | Le Anna | |
| 6,983,938 | B2 | | 1/2006 | Goldsmith | |
| 6,991,233 | B2 | | 1/2006 | Goldsmith, Jr. | |
| 6,994,349 | B2 | * | 2/2006 | Lambert | F41J 7/04 273/392 |
| 7,114,725 | B2 | | 10/2006 | Camp et al. | |
| 7,293,774 | B1 | | 11/2007 | Shawd et al. | |
| 7,306,229 | B2 | | 12/2007 | Rolfe | |
| 7,731,197 | B2 | | 6/2010 | Stutz | |
| 8,684,361 | B2 | * | 4/2014 | Henson | F41J 1/01 273/389 |
| 2008/0277876 | A1 | * | 11/2008 | Riley | F41J 7/04 273/388 |

OTHER PUBLICATIONS

Reset Targets—Four-in-One Metal Reset Target; website—http://www.metaltargets.com/ResetTargets.htm; four pages.

Nevco Targets—Double Pop-Up; website—http://www.nevcotargets.com/catalog.html; 6 pages.

* cited by examiner

AUTOMATICALLY RESETTING SHOOTING TARGET

BACKGROUND OF THE INVENTION

The invention relates generally to the field of shooting targets, and more particularly to a shooting target with a mechanism that causes the target to reset to a different position upon being struck by a projectile, thereby visibly indicating when a particular component of the mechanism has been struck by the projectile.

A wide variety of people, including hunters, stationary target marksmen and action shooting competitors, enjoy shooting sports. While hunting, hunters aim to strike living animals, such as fowl, with projectiles, such as bullets or pellets, and the fowl react visibly to being struck. This visible reaction allows a hunter to perceive when a strike has occurred without inspecting the target. Stationary target marksmen and action shooting competitors fire weapons at non-living targets, such as steel plates and sheets of paper on which human and animal silhouettes are printed. Such non-living targets typically do not move or fall over when struck, and thus target shooters have a distinct disadvantage to hunters in the area of visible changes to a target after a strike has occurred. For example, when a marksman strikes a paper target, the projectile creates a hole through the target the size of the bullet, and the hole is preferably visible from the marksman's location. However, if the target is more than 20 or 30 feet away, a separate optical device, such as a "spotting scope", is necessary in order to locate the hole so the marksman can adjust, if necessary, his or her weapon's sights or scope, without having to walk the distance to the target and back between every shot. The visible changes in conventional targets that have been struck are not apparent using the naked eye, and therefore the benefit to the user can be minimal. Of course, some targets are close enough for the marksman to see, or make a sound or movement to make impact perceptible. However, even such targets that move must be reset so that the next impact is perceptible.

Some marksmen use thick steel plates that are struck by bullets or other projectiles fired by the marksmen. These plates are not damaged by the impact of a bullet, and thus can be used for a long period while providing a stop for the projectile. Such plates can be painted so that the point of impact is visible to the shooter due to a mark that the projectile makes in the paint, in much the same way the hole is made in the paper target. However, a spotting scope is often still required, because the mark is usually quite small.

The need exists for a target that provides a visible indicator to the shooter that the target was impacted by the projectile that is visible without requiring the shooter to move.

BRIEF SUMMARY OF THE INVENTION

There is disclosed herein a target at which projectiles can be launched from a shooting position. The target comprises a plate having a first major side and a second, opposing major side, wherein the second major side is configured to face the shooting position. A carriage is pivotably mounted to the plate on the first major side, and the carriage has first and second legs that are angled relative to one another and extend radially outwardly from a pivot point. The angle between the legs is preferably 180 degrees or less, and no less than about 90 degrees. The carriage is pivotable about an axle from a first position to a second position, and the first and second positions are preferably on opposite sides of the pivot point. At the first position, a first striker of the carriage is disposed adjacent the first major side where the first striker can be reached by a projectile launched from the shooting position without passing through the plate. At the second position a second striker of the carriage is disposed adjacent the first major side where the second striker can be reached by a projectile launched from the shooting position without passing through the plate. In one embodiment, the first position is adjacent a first opening in the plate and the second position is adjacent a second opening in the plate.

The target may have a spring mounted to the carriage that applies a tensile force to the carriage. The tensile force is at a maximum when the carriage is between the first position and the second position, and the tensile force is less than the maximum when the carriage is at the first position and at the second position.

A bracket is mounted to the carriage to which the spring attaches through an adjustable screw. The bracket preferably has a plurality of screw mounting locations for adjusting where the screw mounts to the bracket.

The plate mounts in a base at a lower plate end, and the base disposes the second major side at an acute angle relative to the base.

Figure 2:
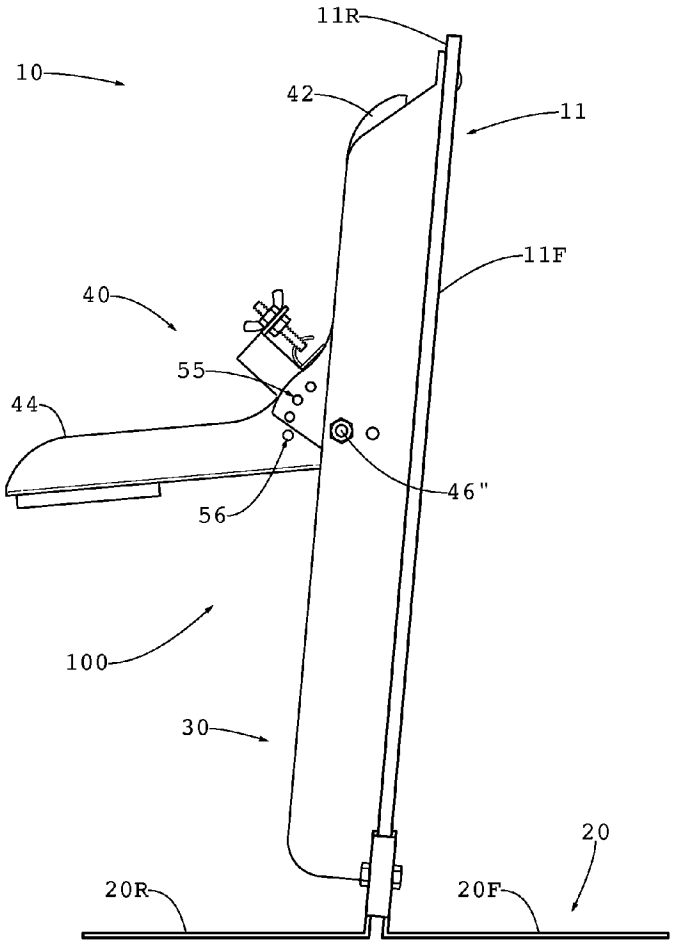
FIG. 2 is a side view illustrating the embodiment of FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Figure 1:
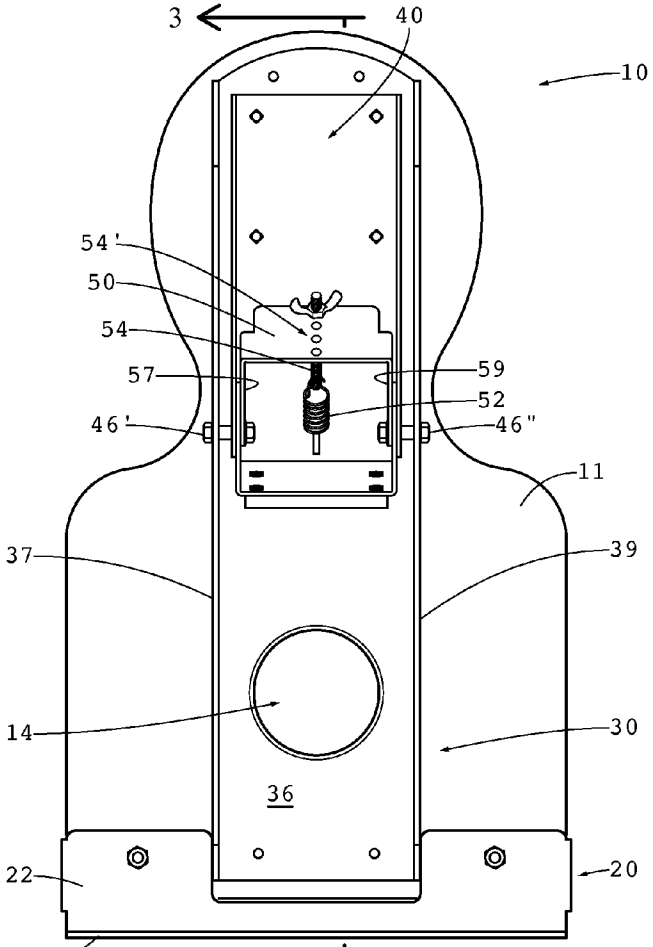
FIG. 1 is a rear view illustrating an embodiment of the invention.

A target 10 in the shape of a human silhouette is shown in FIG. 1. The target 10 is made up of the substantially vertical (in the illustrated, operable configuration) silhouette plate 11 that inserts into a substantially horizontal (in the illustrated, operable configuration) base 20. During use, the base 20 rests upon the ground, which can be a floor made of any material, soil, sand, grass or any other surface present in a shooting environment. The plate 11 stands upright in the base 20 so that it is visible to the shooter from his or her vantage point. The base 20 is larger in the front-to-back horizontal direction than the plate 11 (in the illustrated configuration) to provide a stable stance to the otherwise thin plate 11.

The plate 11 is preferably about 30 inches tall and about 20 inches wide, but these dimensions are not critical and the target can be any size that is useful for target shooting. The plate 11 is preferably made of ⅜ inch thick AR500 steel plate, but can be made of other thicknesses and other suitable materials. Furthermore, although a human silhouette shape is shown and described, any shape is contemplated for the plate 11, including, but not limited to, animals, vehicles, circles, rectangles or irregular shapes.

Figure 3:
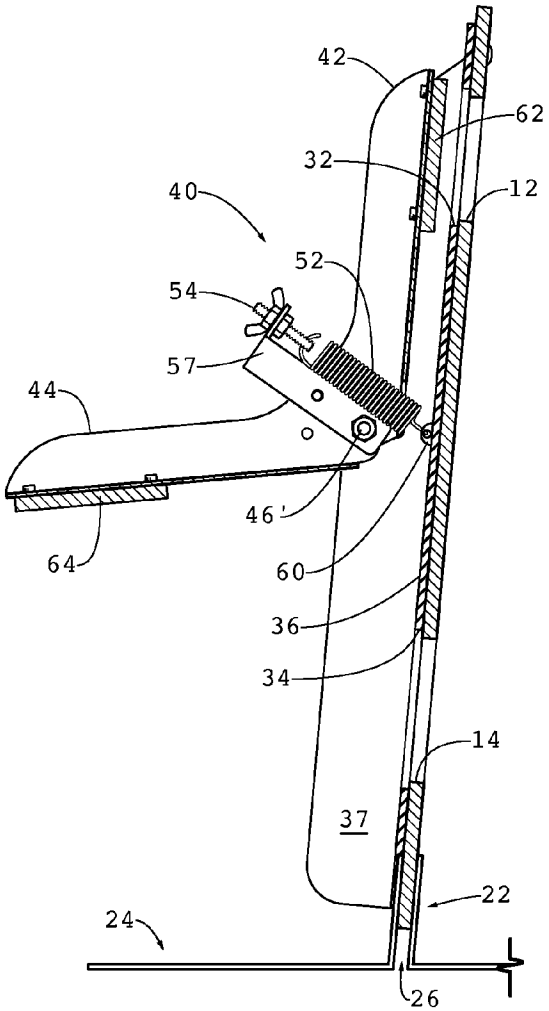
FIG. 3 is a side view in section illustrating the embodiment of FIG. 1 through the line 3-3.

The base 20 is shown in the Figures attached to the lower end of the plate 11 in the orientation shown in FIGS. 2-3. The base 20 has a plate-receiving portion 22 that is rigidly mounted, and angled relative, to a ground-resting portion 24. The plate-receiving portion 22 defines a slot 26 (see FIG. 3) that receives the lower end of the plate 11, and is slightly angled relative to the ground-resting portion 24. The base 20 can clamp the plate 11 by bolts extending through the plate 11.

The base 20 preferably disposes the front surface 11*f* (the impact face) of the plate 11 at an acute angle, such as 80 degrees, relative to the ground, which is parallel to the ground-receiving portion 24 that extends forwardly (toward the shooter) on the base 20. The base 20 preferably disposes the rear surface 11*r* at an obtuse angle, such as 100 degrees, relative to the ground. The plate-receiving portion 22 is thus angled to give the plate 11 a forward lean from vertical when the target 10 rests on a horizontal surface. The acute angle at the impact face causes projectiles that impact the front surface 11*f* to be deflected downwardly toward the ground upon which the target 10 rests. The base 20 is preferably made of sheet steel, such as seven gauge sheet metal, and is preferably about 20 inches wide and about 12 inches from front to back. The material and dimensions of the base are non-critical and can be modified from that described herein.

Figure 9:
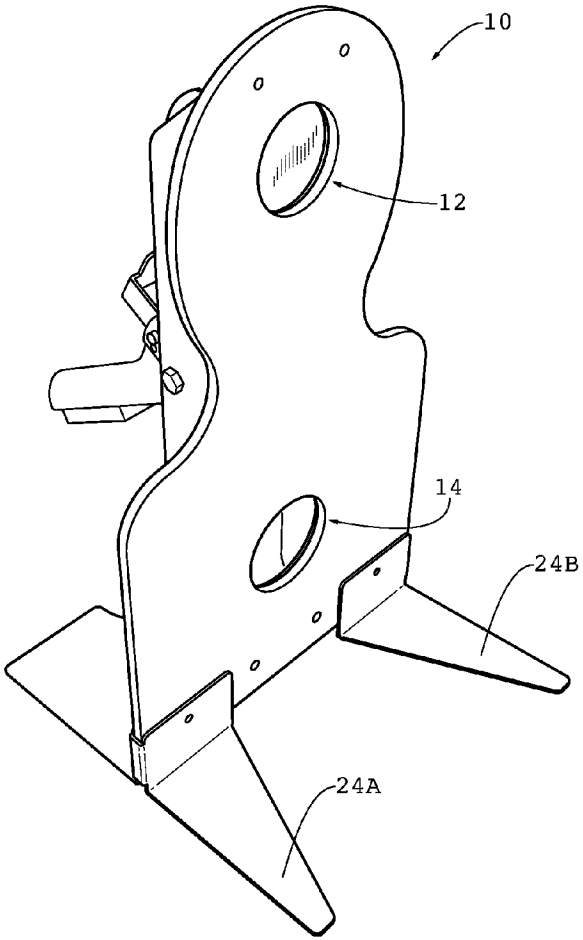
FIG. 9 is a front view in perspective illustrating the embodiment of FIG. 1.
Figure 8:
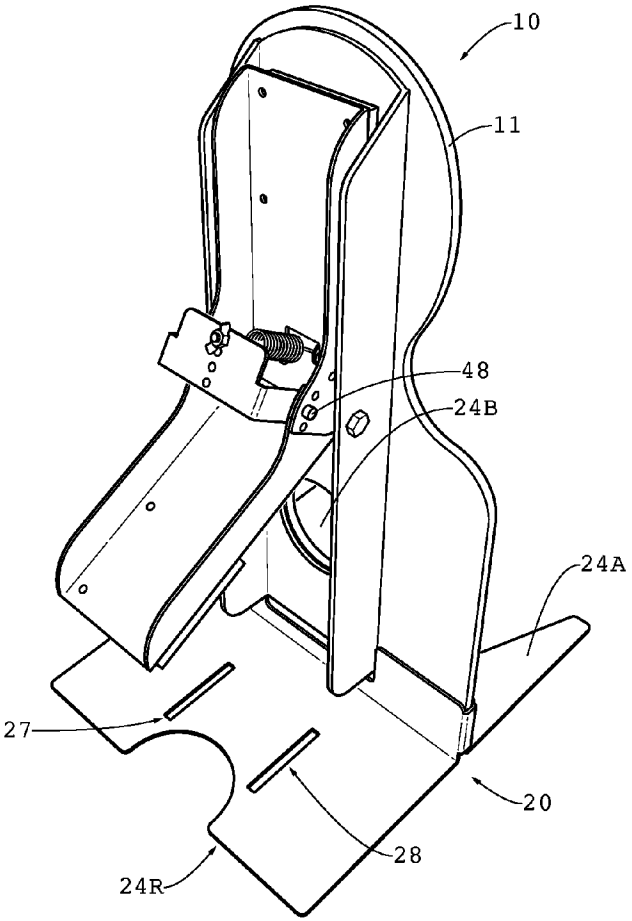
FIG. 8 is a rear view in perspective illustrating the embodiment of FIG. 1.

Two legs 24*a* and 24*b* (see FIGS. 8 and 9) of the base 20 are formed at the front of the base 20 and are spaced apart substantially equally from a longitudinal axis of the plate 11. With this configuration, bullets, or fragments that form when the bullets fracture, that impact the face of the plate 11 strike the ground between the legs 24*a* and 24*b*. The large gap between the legs 24*a* and 24*b*, which are positioned at the base edges, causes fragments formed from impacting bullets to strike the ground on which the target 10 rests, rather than the base 20. This construction reduces damage to the base components and any further ricochet from base components. The rear 24*r* of the ground-receiving portion 24 is wide to support the force of impact of projectiles against the plate 11. The rear portion 24*r* of the base 20 has slits 27 and 28 formed therein to receive a portion of the target 10 during storage and the compacted configuration, as is explained further below.

Two circular openings, preferably the holes 12 and 14 (see FIGS. 3 and 9), extend entirely through the plate 11 and are aligned substantially along a longitudinal axis through the target 10. The holes 12 and 14 are intended to receive projectiles shot therethrough using a firearm or other projectile-launching device, including but not limited to, handguns, rifles, shotguns, muzzle-loading handguns and rifles, compressed air weapons and archery devices such as recurve bows, crossbows and compound bows. As will be described in more detail below, an apparatus 100 is positioned behind the plate 11, and, more specifically, behind the holes 12 and 14. The apparatus 100 disposes visible and pivotably-moveable components, preferably the strikers 62 and 64, behind one of each of the holes 12 and 14. When the shooter shoots a first visible component or striker of that apparatus 100 through the hole 12, the impact causes the apparatus 100 to uncover the hole 12 and move a second visible striker behind the other hole 14. Thus, a successful shot on the first striker automatically actuates the target 10 to a visibly-altered condition in which a second striker is ready to be shot. This visible change indicates a successful impact and advances the target 10 to a different condition. At this different condition, the second component can be shot, which causes the apparatus 100 to move the first component behind the hole 12 and uncover the hole 14 to create a visibly-altered condition in which the first component is now ready to be shot through the hole 12. This can be carried out for as long as the shooter desires without any manual manipulation of the target. Thus, the target is infinitely and automatically resetting.

Although the target 10 is successfully shot through the holes 12 and 14, projectiles that impact the plate 11 will cause little to no damage under normal circumstances due to the materials of which the plate 11 is made. Furthermore, there can be more than the two holes 12 and 14, as will become apparent from the description below, particularly if more than one apparatus 100 described below is mounted to the rear of the target 10. There can also be fewer than two holes, as is described below in relation to FIG. 10.

The apparatus 100 that changes the target 10 between visibly altered conditions preferably includes a channel 30 that is mounted on the rear surface 11*r*. Nuts are preferably screwed onto threaded shafts welded to the rear surface 11*r* that extend through apertures in the channel 30. The channel 30 is shown in FIGS. 1 and 2 having a height slightly less than, or substantially equal to, the height of the plate 11 and a width greater than the holes 12 and 14. The channel 30 has a floor 36 that seats against the plate 11, and sidewalls 37 and 39 that are disposed at about a ninety degree angle to the floor 36. Openings 32 and 34 are formed in the floor 36 and correspond to the holes 12 and 14, respectively, but are slightly larger in diameter than the holes 12 and 14 to prevent damage to the channel 30 if a bullet strikes the edge of the hole 12 or 14. The channel's 30 width is preferably greater than the holes 12 and 14, and the apparatus 100 is preferably disposed substantially entirely between the channel sidewalls 37 and 39.

A carriage 40 is pivotably mounted to the channel sidewalls 37 and 39 via an axle, which may be defined by the coincident axes of a pair of bolts 46' and 46" shown in FIG. 1. The carriage 40 is preferably made up of two separate legs 42 and 44 that are linked to one another in the configuration shown in FIGS. 1-3 by the bolts 46' and 46" and a removable pin 48 (not visible in FIGS. 2-5, see FIGS. 6-8). The legs 42 and 44 are substantially identical, and each is elongated with an end through which the bolts 46' and 46" (and pin 48) extend, and an opposing end with a connecting plate portion that extends radially outwardly from the bolts 46' and 46". There are preferably leg sidewalls that extend substantially parallel to the channel sidewalls 37 and 39 and reinforce the connecting plate portion of each leg, thereby giving the legs 42 and 44 a generally U-shaped cross-sectional configuration. The legs 42 and 44 pivot relative to one another about the axle, but are prevented from pivoting relative to one another when the pin 48 is inserted into the hole 55, as described in more detail below.

A U-bracket 50 has a first leg 57 and a second leg 59 (FIG. 1) that extend substantially parallel to, and adjacent, the channel sidewalls 37 and 39, respectively. The pin 48 (not visible in FIGS. 1-3) extends through one of a series of holes 55 (FIG. 2) in the leg 42 that aligns with a corresponding one of a series of holes 56, only one of which is visible in FIG. 2, in the leg 44. Corresponding holes are formed on the opposite side of the legs 42 and 44, as shown in FIG. 3, as well as in the U-bracket 50. By inserting the pin 48 through the aligned holes 55 and 56 in the legs 42 and 44 and the U-bracket 50, the angle of the leg 42 relative to the leg 44 about the axle is maintained. Preferably, the pin 48 maintains the angle between about 90 degrees and about 120 degrees, but this can vary substantially depending upon many factors, such as mass, spring constant, projectile mass, projectile speed and other factors that will be apparent to the person of ordinary skill from the disclosure herein. When compacted, the angle is substantially 180 degrees.

With the pin 48 removed from the carriage 40, the legs 42 and 44 and the U-bracket 50 can be rotated around the axle relative to one another, such as to expand or contract the components into a compact configuration for storage for shipping, as described below, or to simply vary the angle for strategic reasons. Once the pin 48 is inserted, the legs 42 and 44 and the U-bracket 50 cannot move relative to one another, but the components move as a single unit, and this single unit is the carriage 40.

A screw 54 mounts to the U-bracket 50 through one of the holes 54' formed therein (see FIG. 1). A spring 52 attaches to the tip of the screw 54 and extends from the screw 54 to a fastener 60 (see FIG. 3) that is mounted rigidly to the floor 36 of the channel 30. The spring 52 is thus placed in tension between the screw 54 and the fastener 60.

Figure 5:
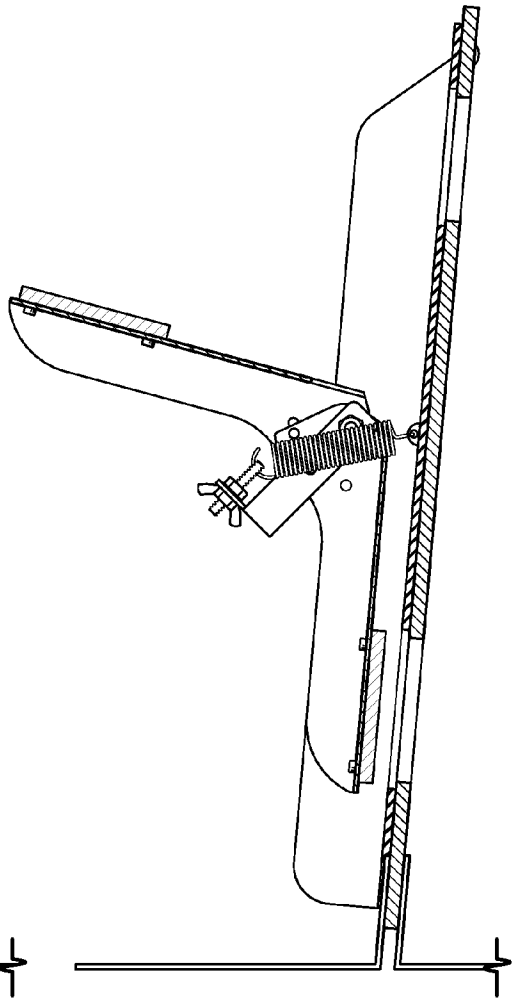
FIG. 5 is a side view in section illustrating the embodiment of FIG. 1 through the line 3-3 after the carriage 40 has advanced to second extreme position.
Figure 4:
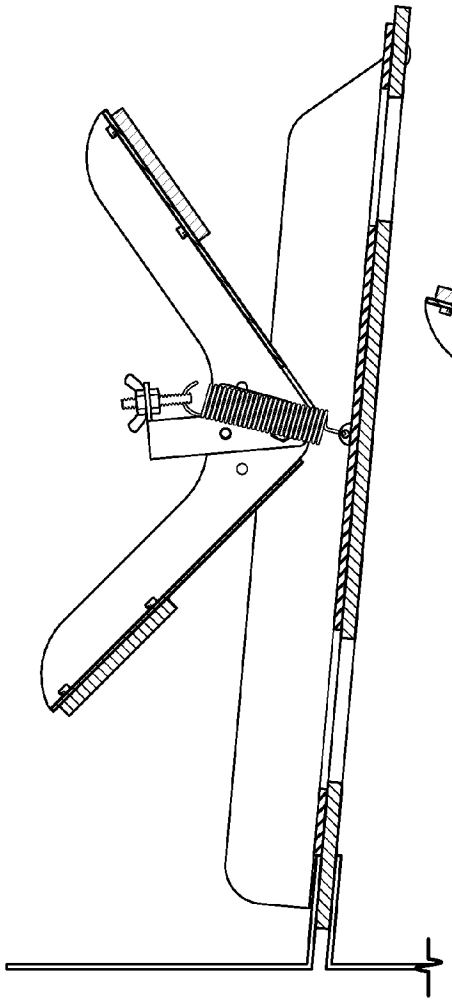
FIG. 4 is a side view in section illustrating the embodiment of FIG. 1 through the line 3-3 after the carriage 40 has advanced to an intermediate position.

The carriage 40 can move between two extreme positions, one of which is shown in FIG. 3 and the other of which is shown in FIG. 5. These two positions can be referred to as when the carriage is up (FIG. 3) and down (FIG. 5) for the configuration of FIG. 1 when the carriage moves vertically. However, this should not be limiting due to the fact that the carriage 40 can be mounted to move horizontally or at any angle between. A central position is shown in FIG. 4 in which the carriage 40 is substantially midway between the two extreme positions, and this is an unstable position, which means a position that the carriage 40 would not typically stay in during normal operation. This is due to the effect of the spring on the carriage 40.

As described above, there are two pairs of corresponding and aligned openings or holes in the channel 30 and the plate 11, and these openings are aligned to provide a single visible opening per pair when the target 10 is viewed from the front surface 11*f*—that is, from the vantage point of the shooter when using the target 10. Of course, there can be more than two openings visible to the shooter, but the embodiment shown is exemplary. A first removable striker, which is preferably the striker plate 62, is preferably removably and firmly mounted near the end of the leg 42 that is spaced farthest from the bolts 46' and 46", and a second removable striker, which is preferably the striker plate 64, is preferably removably and firmly mounted near the end of the leg 44 that is spaced farthest from the bolts 46' and 46". Each of the striker plates 62 and 64 aligns with a corresponding one of the openings in the channel 30 and plate 11 to provide a surface on which the bullet or other projectile that is launched at the target 11 will strike if the projectile passes through the hole 12 or 14 and then the opening 32 or 34. Of course, the striker can simply be formed by a region on one of the legs 42 or 44 if a replaceable striker is not necessary or desired. When one of the striker plates is positioned behind its respective opening, a projectile passing through the opening will strike the striker plate.

The striker plate 62 is mounted to the carriage 40 so that when the carriage 40 is in the extreme position shown in FIG. 3, the striker plate 62 aligns in the hole 12 at the rear surface of the plate 11 (and the channel 30). The striker plate 64 is mounted to the leg 44 so that when the carriage 40 is in the opposite extreme position shown in FIG. 5, the striker plate 64 is aligned in the hole 14 at the rear surface of the plate 11 (and the channel 30). Therefore, if a shooter aims for the opening behind which a respective striker plate is positioned, and successfully directs the projectile through that opening, the projectile will strike the respective striker plate and have the effect on the carriage 40 described herein. Preferably, the faces of the striker plates 62 and 64 are behind, and spaced slightly from, the rear surface of the channel floor 36 to avoid bullet fragments created by impact on the strikers from impacting the edges of the channel 30 or plate 11, thereby ricocheting in directions that could cause harm or damage.

The striker plates 62 and 64 are firmly connected to the carriage 40. Therefore, a projectile striking the striker plate 62 through the hole 12 (when in the configuration of FIG. 3) will impart momentum through the striker plate 62 to the leg 42 and into the entire carriage 40 as a unit. Sufficient impact will impart momentum sufficient to cause the carriage 40 to pivot about the axle from the extreme position shown in FIG. 3 toward and to the intermediate position shown in FIG. 4. During this movement from the extreme position of FIG. 3 to the intermediate position of FIG. 4, the spring 52 elongates due to the geometric relationship between the screw 54, the axle and the fastener 60. When the carriage 40 reaches the intermediate position the spring 52 has elongated to its greatest length, because of the geometry of the components. This causes the spring 52 to exert substantial tension on the bracket 50, which translates into a rotational force to the carriage 40 in one direction. The direction the force is applied is determined by whether a line extending from the fastener 60 to the screw 54 is on one side of the axle or the other. In the intermediate position of FIG. 4, there is no rotational force, because that line is directly over the axle. In the extreme position of FIG. 3 the force is clockwise and in the extreme position of FIG. 5 the force is counterclockwise, where both directions refer to the configuration illustrated.

With sufficient or greater momentum to pivot the carriage 40 just past the intermediate position shown in FIG. 4, the carriage 40 will continue to pivot all the way to the opposite extreme position shown in FIG. 5, even if there is not sufficient momentum due to the impact of the projectile on the striker plate 62 to carry the carriage 40 that far. This is due to the fact that, once the carriage passes the intermediate position, the elongated spring 52 imparts a rotational force tending to pivot the carriage 40 to the extreme position. Because the carriage 40 has momentum due to the impact of the projectile, the spring 52 will tend to continue this pivoting in the same direction toward the extreme position shown in FIG. 5.

Once the carriage 40 is in the position shown in FIG. 5, the striker plate 64 is aligned behind the hole 14 in the same way the striker plate 62 was aligned behind the hole 12 in FIG. 3. This gives the user perceptible, visible confirmation that a strike on the striker plate 62 was successful, because the strike moved the mechanism to a position where the striker plate 64 is visible to the shooter through the hole 14, and another similar shot can be taken through the hole 14. Now the user can launch a projectile at the striker plate 64 through the hole 14. If the projectile strikes the striker plate 64 with sufficient force, momentum will be imparted to the carriage 40 in the opposite direction as described above to cause the carriage 40 to pivot back to the position shown in FIG. 3. This opposite pivoting resets the mechanism of the target 10 to the same configuration as when the user began, thereby giving perceptible, visible confirmation of the strike on the target, and positioning the target to a "shootable" condition without the user having to manually move to the target 10 or any component thereof.

When a striker plate is struck by a bullet, the force of impact is transferred to the carriage 40, thereby moving the connected leg backward as the carriage 40 pivots about the axle. The tensile force applied by the spring 52 increases during the first portion of this pivoting movement away from the extreme position, but after the carriage 40 has pivoted past the intermediate point shown in FIG. 4, the spring tension begins to diminish, thereby causing the opposite leg to position the attached plate over the second hole. The target mount assembly can pivot back and forth under spring tension that is greatest (due to greatest spring elongation) when the target mount assembly is between the two extremes of its travel and least at either extreme. This provides a target assembly that always closes a hole with a target, and preferably alternates from one hole being closed to the other, once the closed hole is struck with a bullet of sufficient impact.

Now the user can launch a projectile at the striker plate 62 through the hole 12. As will become apparent, the shooting and resetting of the target can be carried out an essentially unlimited number of times. Eventually the striker plates 62 and 64 may become worn due to the extreme degree of heat and/or force applied thereto by projectiles, such as bullets travelling at high velocity. The striker plates 62 and 64 can be removed and replaced by similar striker plates by removing bolts or other fasteners attaching the striker plates 62 and 64 to the carriage 40.

Preferably, the upper hole 12 in the target is in the "head" area of the silhouette and is about 3 inches in diameter; the lower hole 14 is in the "chest" area of the silhouette and is about 3.5 inches in diameter. Of course, if the target is another shape, the holes can be placed in any location of advantage to the user, particularly if they are centrally located, or spaced equally from one another and a substantial distance from the edge of the plate 11. The target is designed to be shot through the holes 12 and 14 so that the force of a bullet that passes through one of the holes strikes a first striker plate positioned behind the plate 11 at, and visible through, the hole. This impact actuates the carriage to pivot, thereby positioning a second striker plate to be visible behind the second hole when the first striker plate is pushed away from behind the first opening. Thus, when the first striker plate is opened by the projectile's impact on the first plate, the second plate is thereby moved to a "closed" position over the second hole to indicate to the shooter that the first plate was struck. This permits the shooter to see and shoot the second plate through the second hole. The target mechanism thus removes the need for manual or electrical resetting of the mechanism. Instead, one plate is positioned behind a corresponding hole by impacting the other plate through a corresponding hole with a bullet. A shooter can thereby shoot the plates as many times as desired without having to leave his or her position to reset the targets.

The striker plates are preferably circular with bolt tabs on each. Preferably, the upper plate is about 3.5 inches in diameter and the lower plate is about four inches in diameter. The plates are preferably made of three-eighths inch thick abrasive resistant plate steel. When mounted in position on a corresponding leg, each the plates is positioned behind a corresponding one of the holes 12 and 14 and are bolted by four "grade 8" bolts to the respective leg. Behind each plate is a three-eighths inch thick rubber washer can be mounted to absorb the force of the bullet strike. This allows the carriage 40 to move to the next position without a pronounced bounce, thereby reducing the wear and tear on the plates and apparatus 100.

Although the bolts 46' and 46" provide little resistance to pivoting of the carriage 40, the spring 52 provides a predetermined and adjustable amount of resistance to pivoting. The spring 52 is mounted to the adjustable screw 54, which can adjust the amount of tension in the spring 52. A nut allows the screw 54 to be tightened and loosened, which elongates or contracts the spring 52. Moving the screw 54 away from the spring 52 elongates the spring, thereby increasing the resistance to pivoting of the carriage 40. The spring 52 is preferably pre-elongated when installed, and when the carriage is at one extreme position (i.e., positions a striker plate over a hole), the spring tension is at its least. Thus, when the carriage is at one extreme position or the other, the tension in the spring is lowest. The spring tension is at the greatest when the carriage 40 is pivoted about halfway between the two extreme positions as shown in FIG. 4, and the tension increases from the extreme position which it pivoted from. Therefore, increasing the pre-elongated tension in the spring 52 increases the resistance to pivoting of the carriage 40 from an extreme position. Likewise, decreasing the pre-elongated tension decreases the resistance. The spring 52 thereby forces one striker plate to cover its corresponding opening in the plate 11, or the other striker plate to cover its corresponding opening, until a significant force is encountered, such as when the striker plate is struck by a bullet or other projectile. This is because the spring 52 is at the least amount of tension when the carriage 40 positions a striker plate behind a hole (as shown in FIGS. 3 and 5).

The adjustable screw 54 extends through any one of the openings 54' formed in the bracket 50. Furthermore, moving the screw to a different one of the openings 54' causes a slightly different geometry in the positioning of the spring 52. Because the movement of the carriage 40 is aided by the force of gravity in one direction and is hindered by the force of gravity in the other, the position of the screw 54 in a particular one of the openings 54' allows the degree to which the force of the spring is symmetrical vertically to be adjusted.

It is preferred that, when the user begins using the target 10, the tension in the spring 52 be adjusted to account for the force of impact of the bullets being fired. Thus, a user sets the spring tension so that the amount of force required to move the carriage 40 from the locked positioned to the opposite locked position (covering the other hole) is slightly less than or equal to the anticipated force of impact. Furthermore, it is preferred that position, and thus the geometry, of the spring be adjusted, preferably by positioning the screw 54 in the desired one of the openings 54', to accommodate the force of gravity tending to pull the target mount assembly downwardly, thereby making the force substantially equal in both directions (up and down).

The above-described target 10 is designed for use with a high-powered rifle, such as a rifle chambered for a .270 or .223 round. A target for a lesser or greater powered weapon would have correspondingly different materials to accommodate the differences in impact force. For example, the spring tension and/or the mass of the carriage would be lower for someone using a .22 long rifle, which fires a much lighter projectile at a much slower speed, which results in much less momentum imparted to the carriage 40. Thus, a lower powered weapon that would have a smaller impact would be used with a lighter carriage and less stiff spring, and it would thereby still be able to move the carriage as effectively as a large caliber weapon on a heavier, higher spring tension carriage 40 as described above. The type of material can also be varied if the mass is desirably smaller, such as using polymers and composites for air rifle or archery equipment.

The target 11 is adjustable in at least four ways for the type of weapon that is firing upon it. First, the screw 54 can be loosened or tightened, which decreases or increases the amount of tension in the spring 52. Because the spring elongates at the intermediate position, the tension in the spring when the carriage is at one or the other extreme determines the amount of force that will resist the force imparted to the carriage by a bullet strike on a plate. Thus, the more pre-tensioning of the spring 52, the greater the force that resists pivoting of the carriage 40.

Second, the spring 52 can be replaced with a stiffer or less stiff spring, which has a similar effect to tightening or loosening the screw 54 for obvious reasons, but is also different because the spring constant, k, of the stiffer or less stiff spring will be different. This different spring constant causes the force the spring applies as it is elongated to be different, as is well known with the equation $F=xk$, where F is the force, k is spring constant and x is the distance of elongation.

Third, the screw 54 can be moved from the particular hole 54' that it is positioned in to another hole 54' on the bracket 50. The position of the screw 54 in the bracket 50 affects the geometry of the spring's force applied to the carriage 40. In general, this geometrical variation is to offset the fact that the force of gravity assists the carriage in moving downwardly, but further resists the movement of the carriage 40 upwardly. By moving the screw 54 in the holes 54', the effect of the force of gravity on the carriage 40 can be increased or decreased.

Fourth, the angle between the legs 42 and 44 can be modified by removing the pin 48, pivoting the leg 42 relative to the leg 44, and then inserting the pin 48 again in different aligned holes. This variation in angle between the legs 42 and 44 affects the distance the carriage 40 has to pivot from one extreme position to the other, which has an effect on the force required to pivot the carriage 40 to the opposite extreme.

What is consistent regardless of the weapon being used is that when a first plate of the invention is struck by a projectile, the force of the projectile pushes the first plate backward by rotating the entire carriage 40, thereby pulling the first plate away from the hole or space the first plate previously covered or occupied. This initially rearward movement of the first plate about the bolts 46' and 46" drives the pivotably mounted carriage 40 along an arc about the bolts 46' and 46". Because the plates are behind different holes but are connected through the carriage 40, the movement of the first plate and connected leg causes the leg of the second plate to be moved to the back of the target, thereby covering the second hole or space as shown in the Figures.

Figure 7:
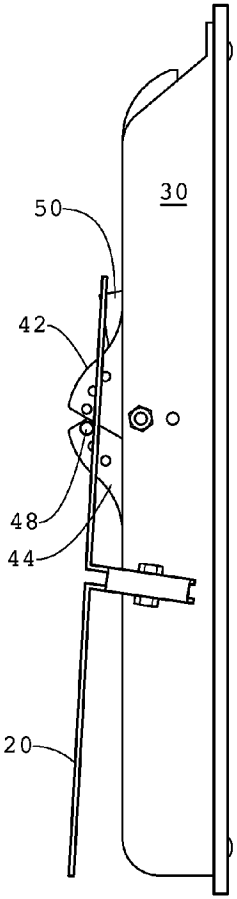
FIG. 7 is a side view illustrating the embodiment of FIG. 1 in a compacted state.
Figure 6:
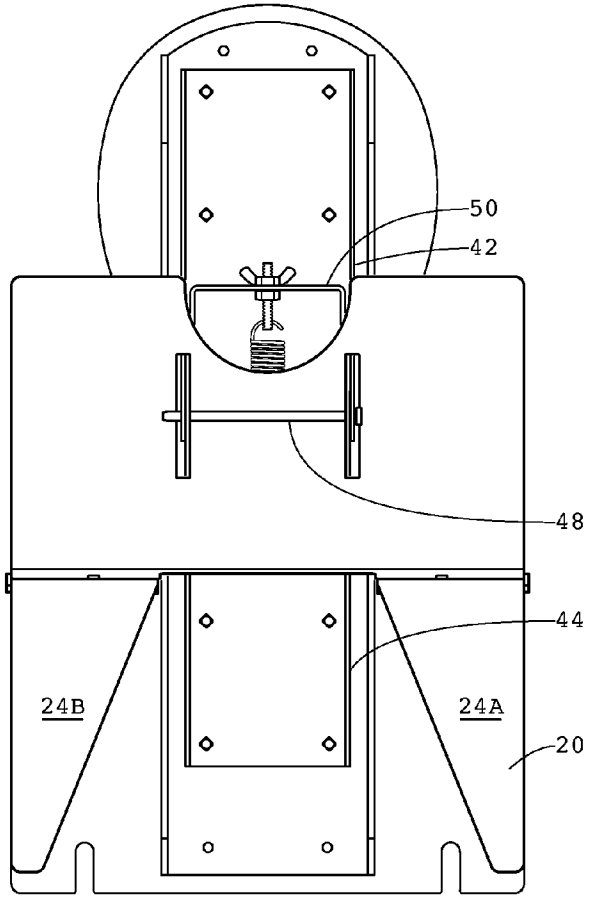
FIG. 6 is a rear view illustrating the embodiment of FIG. 1 in a compacted state.

The target 10 can be readily disassembled to reduce it to a compact configuration as shown in FIGS. 6 and 7. This is accomplished by removing the pin 48 from the carriage 40, which permits the legs 42 and 44 to be pivoted relative to one another around the bolts 46' and 46" to a substantially parallel configuration as shown, which is also referred to as being angled 180 degrees relative to one another. The base 20 is then removed from the bottom of the plate 11 and placed with the ends of the legs 42 and 44 extending through two slots 27 and 28 in the base. The pin 48 is then inserted into the openings of the leg 44 as shown in FIGS. 6 and 7, which maintains the legs 42 and 44 in the positions shown and restricts the base 20 from coming off of, or moving substantially relative to, the legs 42 and 44. Then the entire target 10 can be carried, such as by grasping the pin 48 like a handle, or placing the hand beneath the base 20 between the base legs 24*a* and 24*b*. Expansion from the compacted configuration takes place in the reverse order, by removing the pin 48, placing the base 20 on the ground, inserting the lower end of the plate 11 into the slot 26 and releasing.

Figure 10:
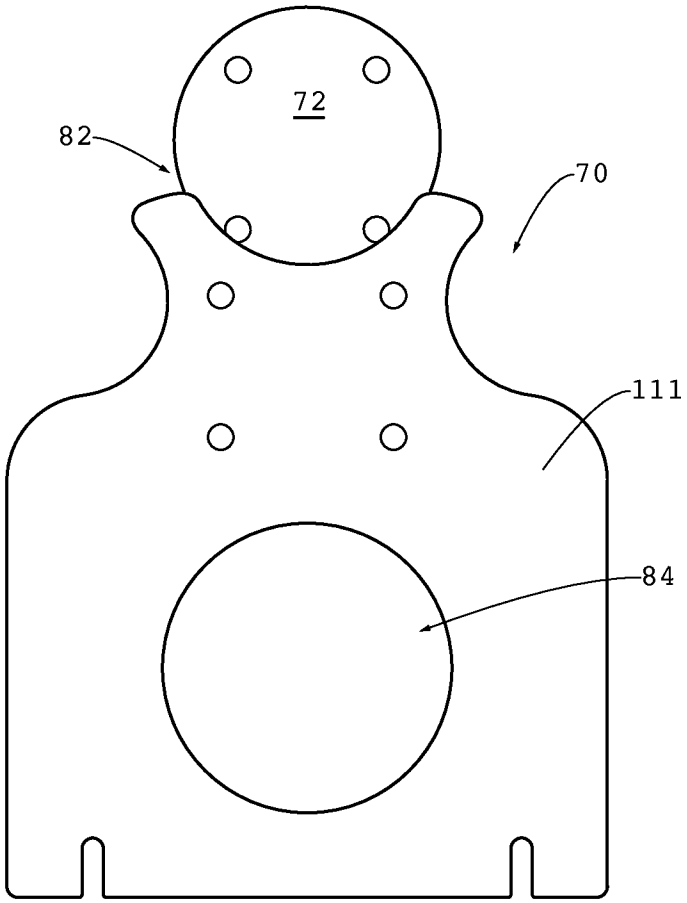
FIG. 10 is a front view illustrating another embodiment of the invention.

It is contemplated that any number of carriages can be mounted to the rear of a plate, and any number of openings can be formed through a target plate. This is only determined by the preference of the manufacturer. It is also contemplated to have a plate with only one opening, such as is shown in FIG. 10. The target 70 has a plate 111 with an opening 84 and a space 82 in which the striker plate 72 is positioned in the configuration shown. An assembly substantially similar to the assembly 100 is mounted to the opposite side of the plate 111, thereby causing the striker plate 72 to be positioned at the space 82. Upon striking the striker plate 72 with a projectile having sufficient momentum, the carriage of the FIG. 10 assembly pivots a second striker plate (not visible, but equivalent to the striker plate 64 of the FIG. 1 embodiment) behind the opening 84 to be visible to the shooter. Thus, the FIG. 10 embodiment illustrates that one or no openings need to be formed in a plate to which the assembly is mounted.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A target at which projectiles can be launched from a shooting position, the target comprising:

(a) a plate having a first major side and a second, opposing major side, the second major side configured to face the shooting position; and (b) a carriage pivotably mounted about a carriage pivot point to the plate on the first major side, the carriage having first and second legs that extend radially outwardly from a leg pivot point about which the first leg is pivotably mounted to the second leg, wherein in a first carriage configuration at least one fastener fixes the first leg to the second leg at a first angle, and in a second carriage configuration said at least one fastener fixes the first leg to the second leg at a second angle that is different from the first angle, and the first leg may pivot relative to the second leg about the leg pivot point when said at least one fastener is unfastened;

wherein the carriage is pivotable about the carriage pivot point from a first position, at which a first striker of the carriage is disposed adjacent the first major side where the first striker can be reached by a projectile launched from the shooting position without the projectile forming a hole in the plate, to a second position, at which a second striker of the carriage is disposed adjacent the first major side where the second striker can be reached by a projectile launched from the shooting position without the projectile forming a hole in the plate;

wherein the first and second positions are on opposite sides of the pivot point.

2. The target in accordance with claim 1, further comprising a spring mounted to the carriage and applying a tensile force to the carriage that is at a maximum when the carriage is between the first position and the second position, and the tensile force is less than the maximum when the carriage is at the first position and at the second position.

3. The target in accordance with claim 2, further comprising a bracket mounted to the carriage to which the spring attaches through an adjustable screw, wherein the bracket has a plurality of screw mounting locations for adjusting where the screw mounts to the bracket.

4. The target in accordance with claim 1, wherein the plate removably mounts in a base at a lower plate end in a shooting configuration, the base disposing the second major side at an acute angle relative to the base.

5. The target in accordance with claim 4, wherein base legs extend away from the plate with a gap therebetween.

6. The target in accordance with claim 1, wherein the carriage pivot point and the leg pivot point are substantially coincident.

7. A target at which projectiles are launched from a shooting position, the target comprising:

(a) a plate having a first major side and a second, opposing major side, the second major side configured to face the shooting position;

(b) a first opening formed in the plate and a second opening formed in the plate spaced from the first opening; and (c) a carriage pivotably mounted about a carriage pivot point to the plate on the first side, the carriage having first and second legs that extend radially outwardly from a leg pivot point that is disposed between the first and second openings and about which the first leg is pivotably mounted to the second leg, wherein in a first carriage configuration at least one fastener fixes the first leg to the second leg at a first angle, and in a second carriage configuration said at least one fastener fixes the first leg to the second leg at a second angle that is different from the first angle, and the first leg may pivot relative to the second leg about the leg pivot point when said at least one fastener is unfastened, the first leg having a first striker and the second leg having a second striker;

wherein the carriage pivots, upon a sufficient force applied to the first striker, about the carriage pivot point from a first position, at which the first striker is disposed adjacent the first opening on the first major side, to a second position, at which the second striker is disposed adjacent the second opening on the first major side;

wherein the carriage pivots, upon a sufficient force applied to the second striker, about the carriage pivot point from the second position, at which the second striker is disposed adjacent the second opening on the first major side, to the first position, at which the first striker is disposed adjacent the first opening on the first major side.

8. The target in accordance with claim 7, further comprising a spring mounted to the carriage and applying a tensile force to the carriage that is at a maximum when the carriage is between the first position and the second position, and the tensile force is less than the maximum when the carriage is at the first position and at the second position.

9. The target in accordance with claim 8, further comprising a bracket mounted to the carriage to which the spring attaches through an adjustable screw, wherein the bracket has a plurality of screw mounting locations for adjusting where the screw mounts to the bracket.

10. The target in accordance with claim 7, wherein the plate mounts in a base at a lower plate end, the base disposing the second major side at an acute angle relative to the base.

11. The target in accordance with claim 10, wherein base legs extend away from the plate with a gap therebetween.

12. The target in accordance with claim 7, wherein the carriage pivot point and the leg pivot point are substantially coincident.

13. A target comprising:

(a) a plate having a first major side and a second, opposing major side;

(b) a first opening formed in the plate and a second opening formed in the plate and spaced from the first opening; and (c) a carriage pivotably mounted about a carriage pivot point to the plate on the first side, the carriage having first and second legs that extend radially outwardly from a leg pivot point that is disposed between the first and second openings and about which the first leg is pivotably mounted to the second leg, wherein in a first carriage configuration at least one fastener fixes the first leg to the second leg at a first angle, and in a second carriage configuration said at least one fastener fixes the first leg to the second leg at a second angle that is different from the first angle, and the first leg may pivot relative to the second leg about the leg pivot point when said at least one fastener is unfastened, the first leg having a first striker and the second leg having a second striker;

wherein the carriage is pivotable about the carriage pivot point from a first position, at which the first striker is disposed adjacent the first opening on the first major side, to a second position, at which the second striker is disposed adjacent the second opening on the first major side.

14. The target in accordance with claim 1, further comprising a base, to which the plate mounts at a lower plate end in a shooting configuration, and in a compact configuration an angle between the legs in the second carriage configuration is about 180 degrees and the base is removably mounted to the carriage.

15. The target in accordance with claim 13, wherein the carriage pivot point and the leg pivot point are substantially coincident.

* * * * *